US007467791B2

(12) United States Patent
Matsushima

(10) Patent No.: US 7,467,791 B2
(45) Date of Patent: Dec. 23, 2008

(54) RECORDING MEDIUM FEEDING DEVICE AND IMAGE FORMING APPARATUS

(75) Inventor: Ryoichi Matsushima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 205 days.

(21) Appl. No.: 11/236,558

(22) Filed: Sep. 28, 2005

(65) Prior Publication Data

US 2006/0076728 A1 Apr. 13, 2006

(30) Foreign Application Priority Data

Sep. 30, 2004 (JP) ..... 2004-289187

(51) Int. Cl.
*B65H 1/08* (2006.01)

(52) U.S. Cl. ..... 271/126; 271/147; 271/152; 271/157; 271/171

(58) Field of Classification Search ..... 271/126, 271/127, 147, 152, 154, 155, 157, 171
See application file for complete search history.

(56) References Cited

U.S. PATENT DOCUMENTS 3,655,183 A * 4/1972 Wagner ..... 271/155
5,078,380 A * 1/1992 Kitazawa ..... 271/9.05
5,228,676 A * 7/1993 Arai et al. ..... 271/117
5,228,677 A * 7/1993 Asakawa ..... 271/126
6,778,262 B2 * 8/2004 Kaburagi et al. ..... 355/405
6,783,126 B2 * 8/2004 Amamoto ..... 271/152

FOREIGN PATENT DOCUMENTS

JP 5-062125 U 8/1993
JP 6-072565 A 3/1994
JP 9-249318 A 9/1997
JP 2000103525 4/2000
JP 2003-081452 A 3/2003

OTHER PUBLICATIONS

Notification for Reasons for Refusal in Japanese Application No. 2004-28187 mailed Oct. 29, 2007 and English translation thereof.
Notification for Reasons for Refusal dispatched Feb. 19, 2008 in U.S. Appl. No. 2004-289187 and English translation thereof.

* cited by examiner

*Primary Examiner*—David H Bollinger
(74) *Attorney, Agent, or Firm*—Banner & Witcoff, Ltd

(57) ABSTRACT

A recording medium feeding device including: a feeding member that feeds a recording medium; a plate on which the recording medium is placed; a power outputting section that outputs a power for elevating the plate in a direction of pressing the recording medium against the feeding member; and a power transmitting section that transmits the power outputted from the power outputting section to the plate, the power transmitting section being adapted so as not to transmit the power to the plate, when a repulsive force against the power for elevating the plate is larger than a predetermined value.

10 Claims, 6 Drawing Sheets

RECORDING MEDIUM FEEDING DEVICE AND IMAGE FORMING APPARATUS

CROSS REFERENCE TO RELATED APPLICATION

This application claims priority from Japanese Patent Application No. 2004-289187, filed on Sep. 30, 2004, the entire subject matter of which is incorporated herein by reference.

TECHNICAL FIELD

Aspects of the invention relates to a recording medium feeding device in which multiple feeding of sheets of paper is unlikely to occur, and an image forming apparatus having the same.

BACKGROUND

Conventionally, there has been proposed a recording medium feeding device provided with a one-way clutch which switches a driving power on or off in order to push up a bottom plate, on occasion of separating and feeding sheets of paper, thereby to elevate a sheet, and in order to push down the bottom plate before feeding a next sheet (see JP-A-2000-103525, for example)

The recording medium feeding device disclosed in JP-A-2000-103525 includes a bottom plate for pressing sheets of paper against a paper feeding roller, a separating pad for separating and feeding the sheets of paper one by one, a bottom plate driving mechanism associated with the paper feeding roller in order to make the bottom plate contacted with or separated from the paper feeding roller on every occasion of feeding a sheet of paper, and a friction member provided on an upper face of the bottom plate. This bottom plate driving mechanism includes a lever for moving the bottom plate up and down, a rotary cam for moving the lever in association, and a clutch mechanism for intermittently transmitting a driving power to the rotary cam. The clutch mechanism for intermittently transmitting the driving power to the rotary cam is a one-way clutch having a spring clutch and a solenoid device. In a state of waiting for the paper feeding, the driving power is not transmitted from the one-way clutch to the rotary cam, and the rotary cam is not be rotated. As a result, the lever which presses one end of the bottom plate downward is not be released, and the one end of the bottom plate is kept in a waiting position against a spring which urges the bottom plate. In this state, on occasion of feeding the paper, the driving force is transmitted from the one-way clutch to the rotary cam, thereby to rotate the rotary cam. Consequently, the lever which is pressing the one end of the bottom plate downward is released, and the one end of the bottom plate is elevated toward the paper feeding roller under a spring force of the spring. Then, the sheet of paper is pressed by the paper feeding roller to be fed. When final two sheets of paper are separated and fed, a sheet of paper in a lower stack is pressed against the friction member of the bottom plate by the pressing lever. In this manner, multiple feeding of the sheets of paper is restrained. As described above, it is possible to move the bottom plate up and down at appropriate timing, and multiple feeding of the sheets of paper can be prevented by means of the friction member and the pressing lever, even when the final two sheets of paper are remained. Moreover, because the lower sheet of paper is pressed with the bottom plate, friction between the lower sheet of paper and the bottom plate is increased, and therefore, it is possible to prevent the lower sheet of paper from being fed together with the upper sheet of paper, even though the friction member is not provided on the bottom plate.

SUMMARY

However, in the related art as described above, the spring has been only means for elevating the bottom plate. Accordingly, the pressing force for pressing the sheets of paper against the bottom plate cannot be adjusted, and large variation may occur in loads for pressing the sheets of paper against the paper feeding roller. Therefore, in the recording medium feeding device which is so constructed that the sheets of paper having a plurality of sizes can be fed, in case where the spring is so designed as to press the sheets of paper against the paper feeding roller with an appropriate load when the sheets of paper having the largest size are mounted on the bottom plate to the full, the sheets of paper having the smallest size will be pressed against the paper feeding roller with larger pressing force than required. For this reason, it has sometimes happened that three or four sheets of paper which have been pressed with the larger pressing force than required may be fed by the paper feeding roller, and in order to separate and feed the sheets of paper which have been fed, one by one, the separating pad must be set to apply a large pressing force to the paper feeding roller. As a result, it has happened that the sheets of paper are rubbed with strong frictional force between the paper feeding roller and the separating pad, and noises occur. Further, there has been a problem that paper dust may be generated and printed letters may be adversely affected.

The present invention provides a recording medium feeding device in which sheets of paper will not be pressed against the paper feeding roller with larger pressing force than predetermined, whereby multiple feeding of the sheets of paper will be restrained, and an image forming apparatus having the same.

According to one aspect of the present invention, there is provided a recording medium feeding device including: a feeding member that feeds a recording medium; a plate on which the recording medium is placed; a power outputting section that outputs a power for elevating the plate in a direction of pressing the recording medium against the feeding member; and a power transmitting section that transmits the power outputted from the power outputting section to the plate, the power transmitting section being adapted so as not to transmit the power to the plate, when a repulsive force against the power for elevating the plate is larger than a predetermined value.

According to the above-described recording medium feeding device, because the power transmitting section does not transmit the power to the plate, when the repulsive force against the power for elevating the plate is larger than the predetermined value, the recording medium is pressed against the feeding member with the pressing force below the predetermined value, and probability that the recording medium may be fed in multiple will be decreased.

BRIEF DESCRIPTION OF THE DRAWINGS

Illustrative aspects of the invention may be more readily described with reference to the accompanying drawings.

DETAILED DESCRIPTION

Figure 1:
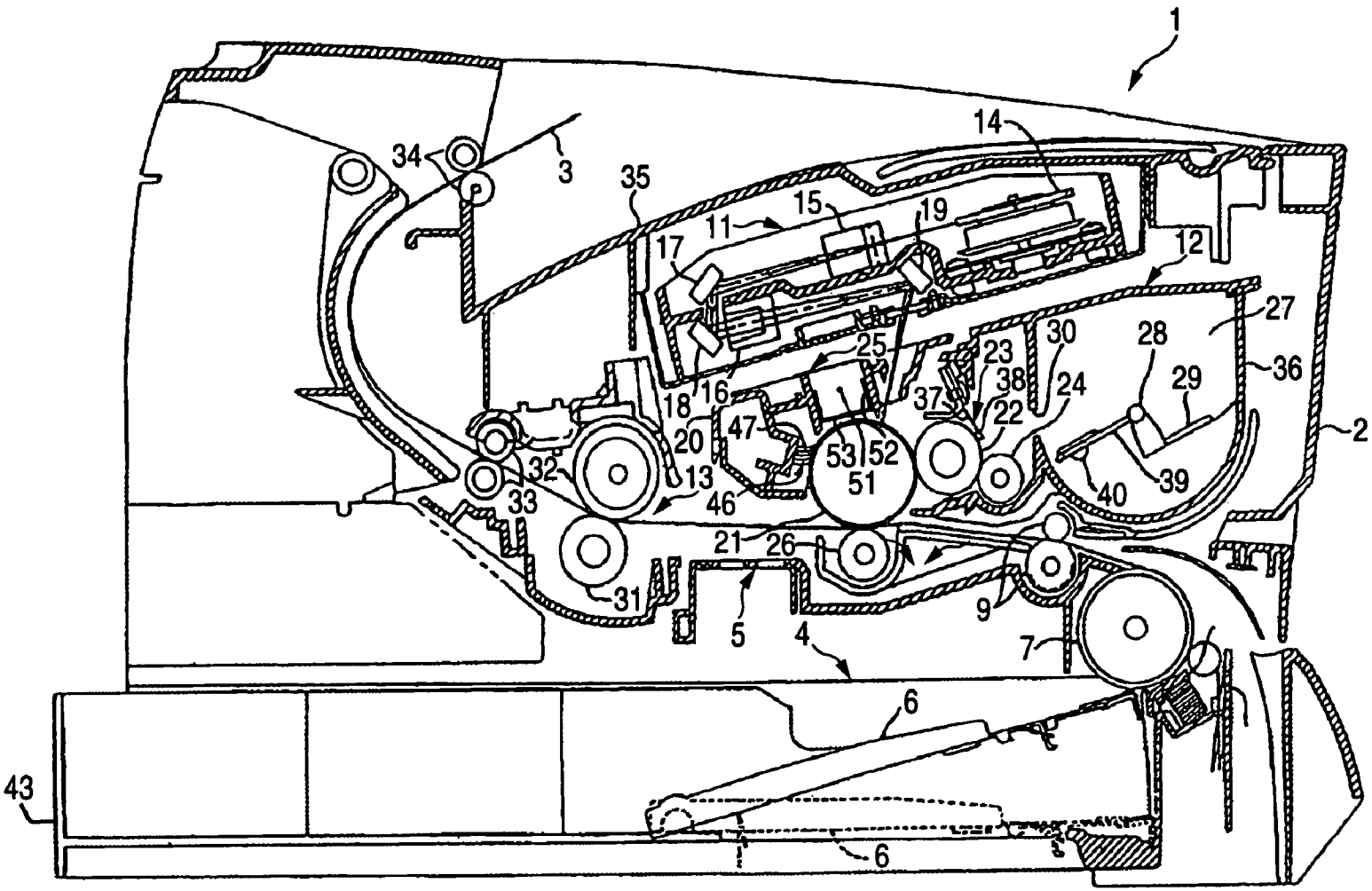
FIG. 1 is a sectional side view showing an essential part of a laser printer as an image forming apparatus according to illustrative aspects of the invention.

An image forming apparatus and a recording medium feeding device according to a first embodiment of the invention will be described with reference to the drawings. FIG. 1 is a sectional side view showing an essential part of a laser printer 1 as the image forming apparatus according to the first embodiment of the invention. As shown in FIG. 1, the laser printer 1 has a casing 2 of a main body which contains therein a feeder unit (recording medium feeding device) 4 for feeding sheets of paper 3 as the recording medium, an image forming unit 5 for forming a predetermined image on the sheet of paper which has been fed.

Structure of the Image Forming Unit

The image forming unit 5 includes a scanner unit 11, a developing unit 12, a fixing unit 13, and so on.

Structure of the Scanner Unit

The scanner unit 11 is provided on an upper part inside the casing 2 of the main body. The scanner unit 11 includes a laser light emitting part (not shown), a polygon mirror 14 which is driven to rotate, lenses 15, 16, reflective mirrors 17, 18, 19, and so on. A laser beam based on predetermined image data which has been emitted from the laser emitting part passes through the polygon mirror 14, the lens 15, the reflective mirrors 17, 18, the lens 16, the reflective mirror 19 in this order, or is reflected as shown by a dotted line in the drawing, and irradiated by rapid scanning onto a surface of a photosensitive drum 21 of the developing unit 12, which will be described below.

Structure of the Developing Unit

The developing unit 12 will be described. In FIG. 1, the developing unit 12 is arranged below the scanner unit 11. The developing unit 12 includes a drum cartridge 20 detachably mounted on the main body casing 2, and the photosensitive drum 21, a developing cartridge 36, a scorotron type charger 25, a transfer roller 26, which are contained in the drum cartridge 20. The developing cartridge 36 is detachably mounted on the drum cartridge 20. The developing cartridge 36 contains therein a developing roller 22, a film thickness regulating blade 23, a supply roller 24, a toner box 27, and so on.

The toner box 27 is filled with non-magnetic mono-component positive-charging-type toner, as a developing agent. As this toner, polymerized toner obtained by copolymerizing polymeric monomer, for example, styrene monomer such as styrene, acryl monomer such as acrylic acid, alkyl (C1-C4) acrylate, alkyl methacrylate, by known polymerization method such as suspension polymerization is employed.

The toner contained in the toner box 27 is agitated by an agitator 29 supported on a rotary shaft 28 which is provided at a center of the toner box 27, and discharged from a toner supply port 30 which is opened in an area adjacent to the supply roller 24 of the toner box 27. Additionally, a window 40 for detecting a remaining amount of the toner is formed in a side wall of the toner box 27, and the window 40 is cleaned by a cleaner 39 which is supported on the rotary shaft 28.

The supply roller 24 is arranged beside the toner supply port 30 so as to rotate in a counter clockwise direction. Moreover, the developing roller 22 is opposed to the supply roller 24 so as to rotate in a counter clockwise direction. These supply roller 24 and developing roller 22 are in contact with each other in a state where they are respectively compressed to some extent.

The supply roller 24 has a roller shaft made of metal, and a roller formed of electrically conductive foam material is covered over the roller shaft. The developing roller 22 has a roller shaft made of metal, and a roller formed of electrically conductive rubber material is covered over the roller shaft. Moreover, a predetermined transfer bias of counter polarity with respect to the photosensitive drum 21 is applied to the developing roller 22.

The film thickness regulating blade 23 is arranged near the developing roller 22. The film thickness regulating blade 23 has a blade body 37 formed of a metallic leaf spring, and a pressurizing portion 38 formed of insulating silicone rubber in a semicircular sectional shape which is provided at a tip end of the blade body 37. In the film thickness regulating blade 23, another end of the blade body 37 at an opposite side to the pressurizing portion 38 is supported by the developing cartridge 36 in vicinity of the developing roller 22, and the pressurizing portion 38 is pressure contacted with the developing roller 22 by elastic force of the blade body 37.

The toner discharged from the toner supply port 30 is supplied to the developing roller 22 with rotation of the supply roller 24. On this occasion, the toner is positively charged by friction between the supply roller 24 and the developing roller 22. Further, the toner supplied to a surface of the developing roller 22 intrudes between the pressurizing portion 38 of the film thickness regulating blade 23 and the developing roller 22, following the rotation of the developing roller 22. The toner intruded between the pressurizing portion 38 and the developing roller 22 is further charged sufficiently by friction, and carried on the developing roller 22 as a thin film having a certain thickness.

Structure of the Photosensitive Drum

The photosensitive drum 21 is arranged adjacent to the developing roller 22 so as to rotate in a clockwise direction in a state opposed to and contacted with the developing roller 22.

A surface of the photosensitive drum 21 is positively charged uniformly by the scorotron type charger 25 which will be described below, and thereafter, exposed to light by rapid scanning of a laser beam from the scanner unit 11 thereby to form an electrostatic latent image based on the predetermined image data. This laser printer 1 is so set that an area of the surface of the photosensitive drum 21 which has been exposed to light by the laser beam has an electric potential of 150 to 170V.

Structure of the Charger

The scorotron type charger 25 is arranged above the photosensitive drum 21 keeping a predetermined distance so as not to be in contact with the photosensitive drum 21. This scorotron type charger 25 is an charger of scorotron type for positive electrification which generates corona discharge from an electrifying wire such as tungsten. The scorotron type charger 25 has a corona wire 51, a shield 52 covering the corona wire 51, a grid electrode 53 provided so as to be opposed to the corona wire 51, and is so constructed as to positively charge the surface of the photosensitive drum 51. This laser printer 1 is so set that the electric potential of the surface of the photosensitive drum 21 after charging may become 870V.

When the toner carried on the developing roller 22 and positively charged is brought into contact with the photosensitive drum 21 by the rotation of the developing roller 22, the toner is supplied to the electrostatic latent image formed on the surface of the photosensitive drum 21, that is, the area exposed to light by the laser beam and having a lowered electric potential, out of the surface of the photosensitive drum 21 which has been positively charged uniformly, and is selectively carried thereby to change the electrostatic latent image into a visual image. In this manner, reverse development is achieved. In this laser printer 1, voltage of 400 to 450V is applied to the developing roller 22 as a bias voltage.

Structure of the Transfer Roller

Underneath the photosensitive drum 21, a transfer roller 26 opposed to the photosensitive drum 21 is arranged so as to rotate in a counterclockwise direction. The transfer roller 26 has a roller shaft made of metal and a roller formed of conductive rubber material which is covered over the roller shaft, and transfer bias of counter polarity with respect to the photosensitive drum 21 is applied to the transfer roller 26. For this reason, the visual image carried on the photosensitive drum 21 is transferred onto the sheet of paper, while the sheet of paper is passing between the photosensitive drum 21 and the transfer roller 26.

Structure of the Fixing Unit

The fixing unit 13 is arranged downstream from and adjacent to the developing unit 12, as shown in FIG. 1, and includes a heating roller 32, a pressurizing roller 31 pressed by the heating roller 32, and a pair of conveying rollers 33 which are provided downstream from the heating roller 32 and the pressurizing roller 31. The heating roller 32 is provided with a halogen lamp made of metal for heating, and fixes by heating the toner which has been transferred onto the sheet of paper in the developing unit 12, while the sheet of paper passes between the heating roller 32 and the pressuring roller 31. Thereafter, the sheet of paper is be conveyed by the conveying rollers 33 toward a pair of discharging rollers 34. The sheet of paper conveyed to the pair of the discharging rollers 34 is discharged onto a discharge tray 35 by means of the discharging rollers 34.

Structure of an Electrically Conductive Brush

The laser printer 1 in this embodiment is provided with an electrically conductive brush 46 for catching paper dust adhered to the surface of the photosensitive drum 21 after the transfer. The electrically conductive brush 46 is arranged in contact with the surface of the photosensitive drum 21, in the upstream from a position opposed to the scorotron type charger 25 in a rotation direction of the photosensitive drum 21.

This electrically conductive brush 46 is supported by a frame of the drum cartridge 20, and includes a plurality of sheet-like brushes 47 which are arranged along the rotation direction of the photosensitive drum 21 so as to sequentially come into contact with the photosensitive drum 21. Moreover, the electrically conductive brush 46 is electrically connected to an electrode which is not shown, and voltage of about 1.3 kV is applied thereto.

Structure of the Feeder Unit

Figure 2A:
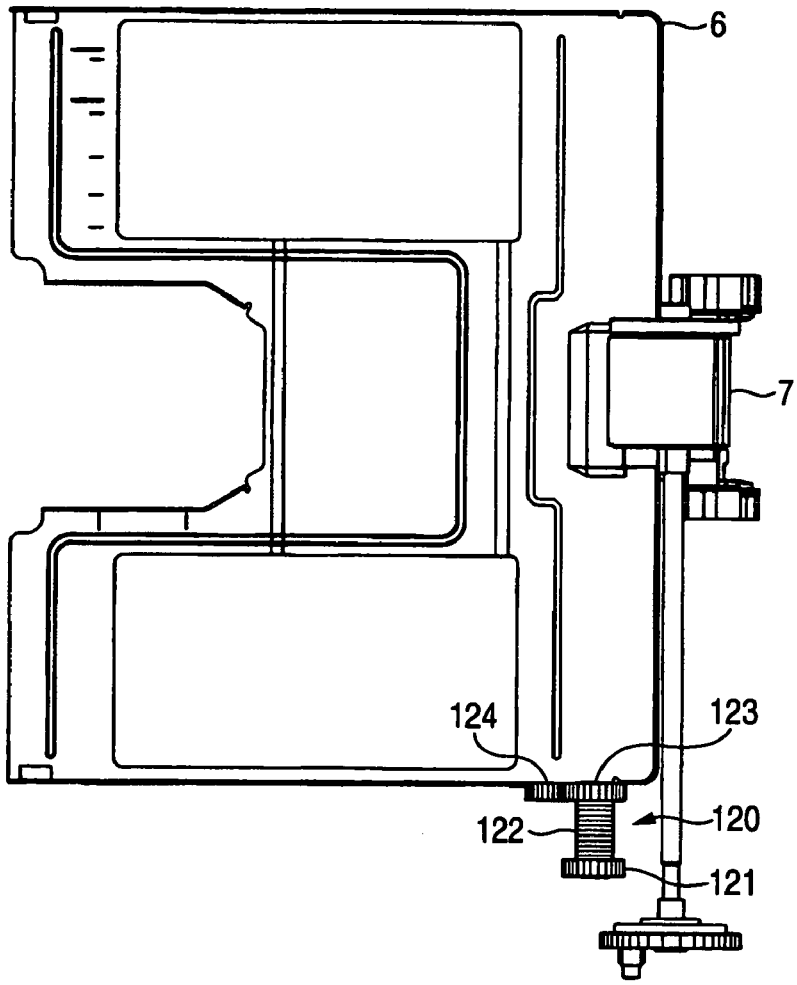
FIGS. 2A and 2B are a plan view and a side view showing an interior or a feeder unit of the recording medium feeding device according to illustrative aspects of the invention.
Figure 2B:
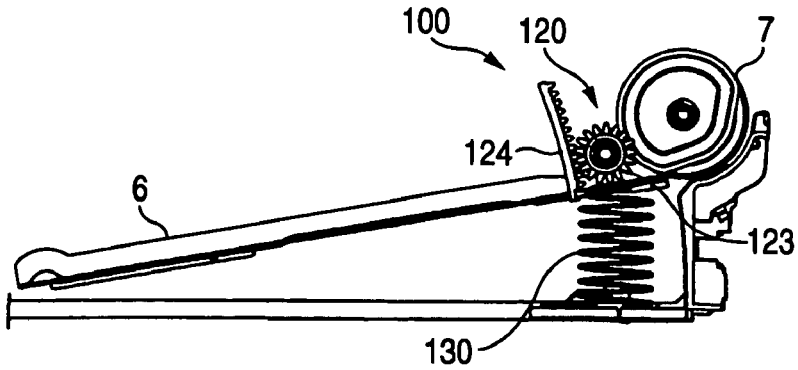

Now, the feeder unit 4 will be described referring to FIGS. 1 to 3. FIGS. 2A and 2B are a plan view and a side view showing an interior of the feeder unit 4 as the recording medium feeding device. The feeder unit 4 includes, as shown in FIG. 1, a paper feeding tray 43 detachably mounted to a bottom part inside the main body casing 2, a paper pressing plate (a pressing plate) 6 provided inside the paper feeding tray 43, a paper feeding roller (feeding member) 7 in a substantially D-shape in sectional view and a separating pad (a separating member) 8 which are provided in an upper area of one side end part of the paper feeding tray 43, registration rollers (conveying member) provided downstream from the paper feeding roller 7 in a paper conveying direction for conveying the sheet of paper 3 which has been separated into one sheet by the separating pad 8 and conveying it toward the image forming unit 5, and a paper dust removing roller 10 provided in contact with the paper feeding roller 7 in a passage for conveying the sheet of paper 3 between the separating pad 8 and the registration rollers 9 and adapted to remove the paper dust which has been generated when the sheet 3 was rubbed between the paper feeding roller 7 and the separating pad 8. As shown in FIG. 2, the feeder unit 4 is further provided with a pressing plate driving unit 100 for moving the paper pressing plate 6 up and down, which will be described below. The feeder unit 4 is so constructed as to be capable of feeding the recording medium having a plurality of sizes.

Structure of the Pressing Plate Driving Unit

Figure 8B:
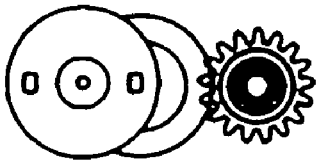
FIGS. 8A and 8B are a side view and a perspective view showing a driving motor as a power outputting section which outputs power for elevating a paper pressing plate against a paper feeding roller according to illustrative aspects of the invention.
Figure 8A:
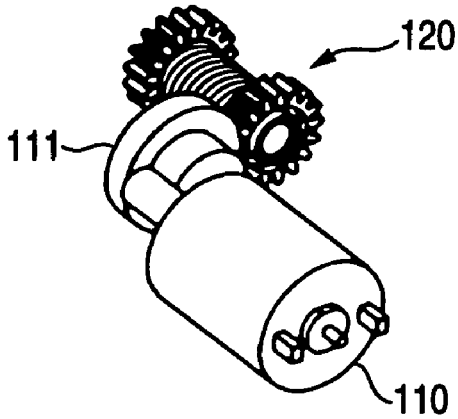

FIGS. 8A and 8B are a perspective view and a side view showing a driving motor (power output section) 110 which outputs the power for elevating the paper pressing plate 6 in a direction of pressing the sheet of paper 3 against the paper feeding roller 7. As shown in FIGS. 2A, 2B, 8A and 8B, the pressing plate driving unit 100 includes the driving motor 110, a one-way clutch mechanism (power transmitting section) 120 which is rotated by the power outputted from the driving motor 110 about an axis parallel to an axial direction of the paper feeding roller 7 by way of a driving gear 111 which is connected to the driving motor 110, and an urging spring (a pressing plate urging member) 130 which is provided between an end of the paper pressing plate 6 in the paper conveying direction and the bottom of the main body casing 2, for urging the paper pressing plate 6.

Structure of the One-Way Clutch Mechanism

Figure 3:
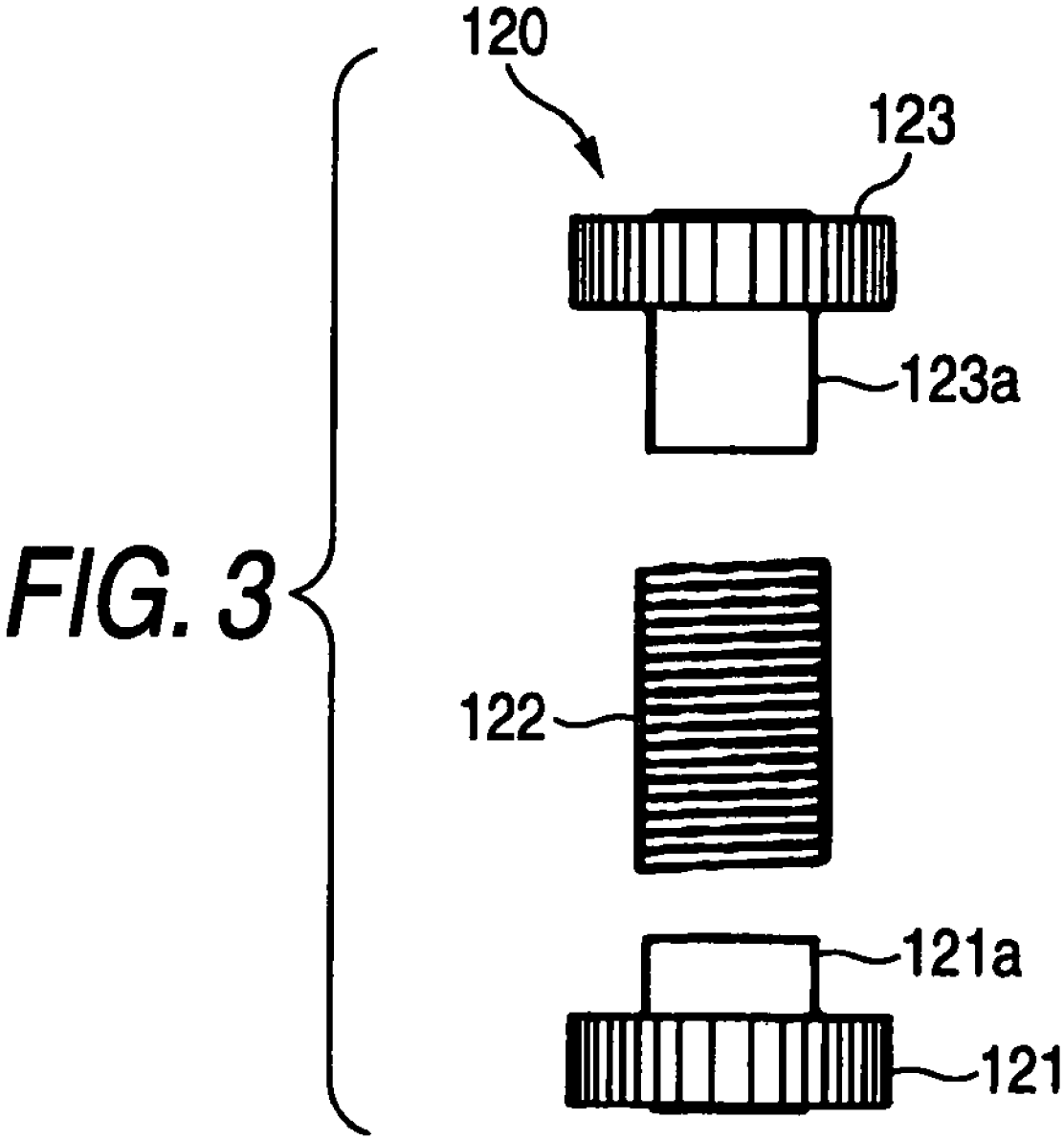
FIG. 3 is an enlarged view showing a structure of a one-way clutch mechanism as a power transmitting section according to illustrative aspects of the invention.

FIG. 3 is an enlarged view showing a structure of the one-way clutch mechanism 120 as the power transmitting section. The one-way clutch mechanism 120 includes an input gear (an input part) 121 coupled to the driving motor by way of the driving gear 111 to receive the power from the driving motor 110, a one-way clutch spring (a transmitting part) 122 for transmitting the power inputted from the input gear 121, an output gear (an output part) 123 for outputting the power transmitted from the one-way clutch spring 122, and a rack 124 fixed to a side part of the paper pressing plate 6 and meshed with the output gear 123.

Example of Image Forming Operation

Operation for printing in the laser printer 1 in this embodiment having the above described structure will be explained referring to FIG. 1. When the surface of the photosensitive drum 21 of the developing unit 12 has been uniformly charged by the scorotron type charger 25 and irradiated with the light which has been modulated according to the image information from the scanner unit 11, a latent image is formed on the surface of the photosensitive drum 21. This latent image is formed into a visual image with toner by the developing roller 22, and this visual image is conveyed to the transferring position by the photosensitive drum 21. Meanwhile, in the feeder unit 4, the pressing plate driving unit 100 is actuated to elevate the paper pressing plate 6 around a pivot 6*a* as an axis, and the sheets of paper 3 stacked on the paper pressing plate 6 is pressed against the paper feeding roller 7 to be fed by the paper feeding roller. Then, the sheet of paper 3 is fed to the transfer position by means of the paper feeding roller 7 and the registration rollers 9, and the visual image is transferred to the sheet with the transfer bias which is applied by the transfer roller 26.

Then, the sheet of paper 3 is conveyed to the fixing unit 13, and clamped between the heating roller 32 and the pressuring roller 31 so that the visual image on the sheet of paper 3 is fixed on the sheet 3 while the sheet is conveyed. Then, the sheet of paper 3 is discharged onto the discharge tray 35 in an upper part of the laser printer 1 by a pair of the conveying rollers 33 and a pair of the discharging rollers 34, and thus, the image forming operation is completed.

Example of Paper Feeding Operation

Figure 4:
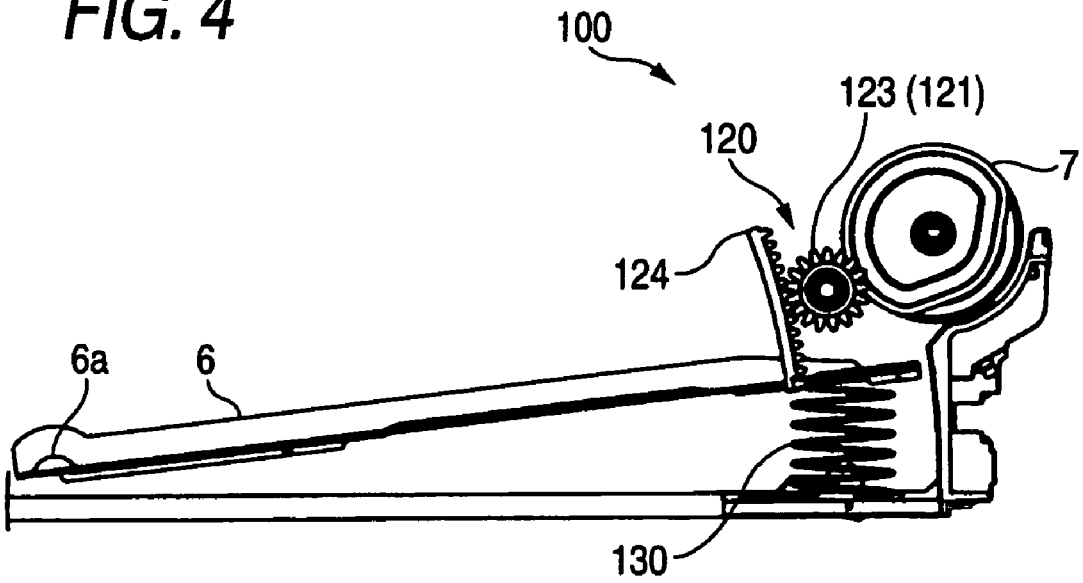
FIG. 4 is a side view showing the interior of the feeder unit, before image forming operation starts according to illustrative aspects of the invention.

In the feeder unit 4 in this embodiment, paper feeding operation during the image forming operation will be described referring to FIGS. 1 to 5. Situation of the interior of the feeder unit 4 before the image forming operation starts will be first described. FIG. 4 is a side view of the interior of the feeder unit 4 before the image forming operation starts.

In a state before the image forming operation starts, the paper pressing plate 6 stays still at a position where a sum of gravities of the paper pressing plate 6, the sheets of paper 3 (not shown) stacked on the paper pressing plate 6, and the rack 124 fixed to the side part of the paper pressing plate 6 is equal to a spring force of the urging spring 130 which urges the paper pressing plate 6. The urging spring 130 is so designed that when the paper pressing plate 6 is filled with the sheets of paper 3 having the maximum feedable size, the sheets 3 does not come into contact with the paper feeding roller 7. It is to be noted that in some cases, the sheets of paper 3 come into contact with the paper feeding roller 7 even before the printing starts, depending on sizes or amounts of the sheets of paper 3 which are stacked on the paper pressing plate 6.

Figure 5:
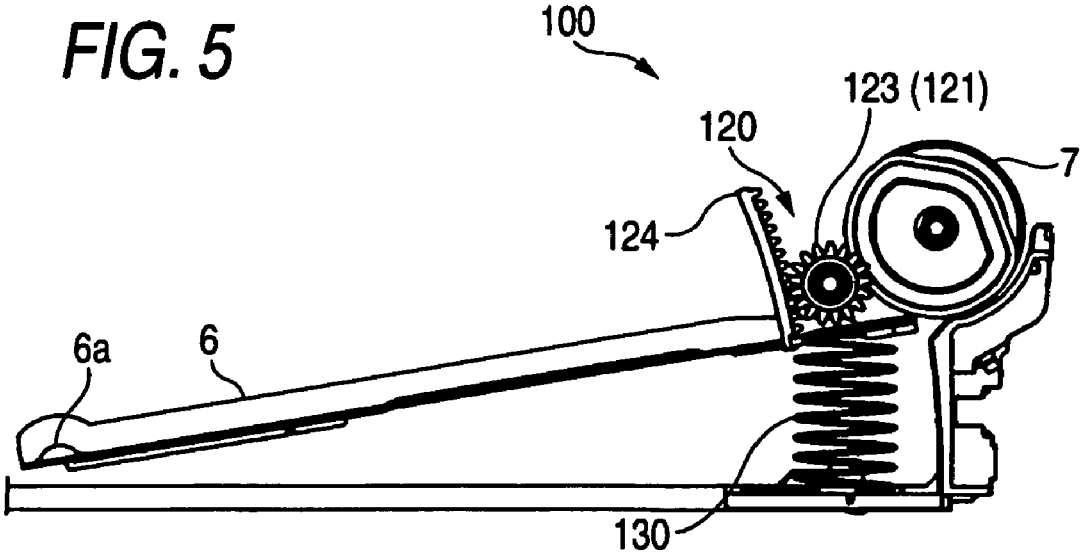
FIG. 5 is a side view showing the interior of the feeder unit, after the image forming operation has started according to illustrative aspects of the invention.

Then, the paper feeding operation after the image forming operation has started will be described. FIG. 5 is a side view of the interior of the feeder unit 4 after the image forming operation has started.

When the image forming operation has started, the driving motor 110 starts to be driven, and the input gear 121 of the one-way clutch mechanism 120 which is engaged with the driving gear 111 is rotated in a clockwise direction in FIG. 5 by the power from the driving motor 110. When the input gear 121 is rotated, a torque of the input gear 121 is transmitted to the one-way clutch spring 122 wound around and engaged with a columnar projection 121*a* which is apart of the input gear 121. Following the rotation of the input gear 121, the one-way clutch spring 122 is also rotated in a clockwise direction in FIG. 5. The one-way clutch spring 122 is wound around and engaged with a columnar projection 123*a* which is a part of the output gear 123. Because frictional force of an area where the one-way clutch spring 122 is engaged with the output gear 123 is larger than a torque of the one-way clutch spring 122, the torque of the one-way clutch spring 122 is also transmitted to the output gear 123 thereby to rotate the output gear 123 in a clockwise direction in FIG. 5.

With the rotation of the output gear 123, the rack 124 meshed with the output gear 123 is elevated, and at the same time, the paper pressing plate 6 to which the rack 124 is fixed is elevated. Then, the sheets of paper 3 (not shown) stacked on the paper pressing plate 6 is pressed against the paper feeding roller 7. When a repulsive force against the pressing force which is applied to the paper pressing plate 6 from the paper feeding roller 7 by way of the sheets of paper 3 has exceeded a determined value, the one-way clutch spring 122 is no longer able to rotate the output gear 123. Consequently, the one-way clutch spring 122 engaged with the output gear 123 is slackened around the rotation axis, and the area where the one-way clutch 122 is engaged with the output gear 123 is weakened in tightness. As a result, the one-way clutch 122 idly rotates with respect to the output gear 123. For this reason, the rotation force more than predetermined is not be transmitted to the output gear 123, and the rack 124 meshed with the output gear is no longer elevated, nor the paper pressing plate 6 be elevated. In this manner, the pressing force applied to the sheets of paper 3 against the paper feeding roller 7 is restrained.

After the sheets of paper 3 have been pressed against the paper feeding roller 7, the paper feeding roller 7 starts to be driven, and is rotated in a counterclockwise direction in FIG. 5. Then, the uppermost sheet 3 among the sheets of paper 3 stacked on the paper pressing plate moves by frictional force with the paper feeding roller 7 following the rotation of the paper feeding roller, and is fed. The pressing force applied to the sheets of paper 3 against the paper feeding roller 7 which varies depending on the sizes or loading amounts of the sheets of paper 3 is the smallest in case where the sheets of paper 3 having the maximum feedable size are stacked on the paper pressing plate 6 to the full. In this case, the sheets of paper 3 to be fed by the paper feeding roller 7 are most unlikely to be fed in multiple. However, in case where the sheets of paper 3 having the minimum feedable size are stacked on the paper pressing plate 6 to the full, the spring force of the urging spring 130 becomes too large, and in some cases, not only the one-way clutch mechanism 120 but also the urging spring 130 may press the sheets of paper 3 against the paper feeding roller 7. In this case, the pressing force becomes larger than in the case where the sheets of paper 3 having the maximum feedable size are stacked on the paper pressing plate 6 to the full, and multiple feeding of the sheets 3 may sometimes occur. However, the sheets 3 is separated one by one by the separating pad 8 which is in contact with the paper feeding roller 7. The conventional separating pad has required strong frictional force in order to separate only one sheet, when three or four sheets have been fed at a time, and had to be pressed against the paper feeding roller with larger pressing force. In contrast with such conventional separating pad, the separating pad 8 in this embodiment may be so designed as to be pressed against the paper feeding roller 7 with smaller pressing force than the conventional separating pad, since probability of multiple feeding of the sheets 3 is lower, and the number of the sheets 3 to be fed at a time is smaller than with the conventional separating pad. Accordingly, because the sheet of paper 3 clamped between the paper feeding roller 7 and the separating pad 8 is not be severely rubbed, generation of paper dust and occurrence of a large frictional sound caused by severe friction can be prevented.

After the sheet of paper 3 has been fed to the paper feeding roller 7 and rubbed by the separating pad 8, a leading end of the sheet 3 passes the paper dust removing roller 10, and is further conveyed to the registration rollers 9. At a time point when the leading end of the sheet 3 has been clamped between the registration rollers 9, the rotation of the paper feeding roller 7 and the drive of the driving motor 110 is stopped. Even though the rotation of the paper feeding roller 7 has stopped, the sheet of paper 3 is conveyed if the leading end of the sheet 3 has been clamped between the registration rollers 9. It is to be noted that the paper feeding roller 7 may be driven by the driving motor 110.

When the driving motor 110 has stopped to be driven, the output of the driving motor 110 is converted to a power for lowering the paper pressing plate 6, and the power outputted from the driving motor 110 rotates the input gear 121 of the one-way clutch mechanism 120 in a counterclockwise direction in FIG. 5. Following the rotation of the input gear 121, the torque of the input gear 121 is transmitted to the one-way clutch spring 122 which is engaged with the input gear 121, and the one-way clutch spring 122 is also rotated in a counterclockwise direction in FIG. 5. When the one-way clutch spring 122 is rotated in a counterclockwise direction, the one-way clutch spring 122 is tightened around the rotation axis, and the frictional force in the area where the one-way clutch spring 122 is wound around the columnar projection 123*a* which is a part of the output gear 123 becomes larger. As a result, the torque of the one-way clutch spring 122 is transmitted to the output gear 123, and the output gear 123 is also rotated in a counterclockwise direction in the same manner. Following the rotation of the output gear 123, the rack 124 in mesh with the output gear 123 is lowered, and at the same time, the paper pressing plate 6 to which the rack 124 is fixed is lowered. When the paper pressing plate 6 has been lowered up to the waiting position, as shown in FIG. 4, where the sheet of paper 3 (not shown) is not fed by the paper feeding roller 7, the driving motor 110 stops outputting the power. In case of forming images continuously, the above described paper feeding operation is repeated. Whether or not the paper pressing plate 6 has been lowered up to the waiting position where the sheet 3 is not fed by the paper feeding roller 7 can be detected by a sensor, or by counting a determined time from a time point when the output of the driving motor 110 has been converted to the power for lowering the paper pressing plate 6, or by some other means.

Provided that spring constant of the urging spring 130 in the conventional recording medium feeding device in which the paper pressing plate is elevated only by the urging spring 130 is in a range of 600 to 800 g weight/cm, it is possible to set the spring constant of the urging spring 130 in this embodiment in a range of 400 to 600 g weight/cm. It is needless to say that the spring constant of the urging spring 130 is not necessarily limited to the range of 400 to 600 g weight/cm, but may vary according to various conditions such as feedable sizes of the sheets, kinds of the paper, spaces between the sheets on occasion of continuous printing, types of the driving motor 110, and so on.

According to this embodiment, it is possible to reduce the probability that the sheets of paper 3 may be fed in multiple, and to minimize the number of the sheets 3 which are fed at a time, and therefore, the pressure with which the separating pad 8 is pressed against the paper feeding roller 7 can be made smaller than with the conventional separating pad. For this reason, the sheet of paper 3 clamped between the paper feeding roller 7 and the separating pad 8 is rubbed with small frictional force, and thus, generation of paper dust and occurrence of a large frictional sound caused by severe friction can be prevented.

According to the recording medium feeding device, the power transmitting section includes the input part 121 into which the power outputted from the power outputting section is inputted, the output part 123 for outputting the power which has been inputted into the input part in order to elevate the pressing plate, and the helical spring 122 which is wound around the input part and the output part and adapted to rotate in a direction of being slackened by the power outputted from the power outputting section, and the helical spring is slackened in an area wound around the input part or the output part thereby to idly rotate, when the power outputted from the power outputting section has been inputted into the input part in an amount more than the predetermined value, whereby the power cannot be transmitted to the pressing plate. Because the helical spring does not transmit the power to the pressing plate when the power outputted from the power outputting section has been inputted into the input part in an amount more than the predetermined value, the recording medium is pressed against the feeding member 7 with the pressing force below the predetermined value, and probability that the recording medium may be fed in duplicate is decreased. Moreover, because the helical spring is employed in the power transmitting section, and the helical spring is wound around the input part and the output part, the power transmitting section has a simple structure, and can be easily assembled, thus enabling the cost to be reduced.

Also, the recording medium feeding device is further provided with the pressing plate urging member 130 for urging the pressing plate in an elevating direction. Therefore, because the pressing plate has been urged in advance and already elevated, a distance for elevating the pressing plate by the power transmitting section can be made smaller, and time for driving the pressing plate can be shortened. As a result, it is possible to make spaces between the sheets smaller.

Further, the pressing plate urging member 130 is capable of feeding the recording medium having a plurality of sizes, and constructed in such a manner that in case where the recording medium having the maximum feedable size is mounted on the pressing plate to the full, the recording medium dose not come into contact with the feeding member 7 while the power for elevating the pressing plate is not outputted. As a result, because influence of the pressing plate urging member on the pressing force for pressing the recording medium against the feeding member is decreased, and too much pressing force is not be applied, probability that the recording medium is fed in duplicated is decreased.

Moreover, after the output of the power for elevating the pressing plate has been stopped, the power for lowering the pressing plate is outputted from the power outputting section, the power outputted from the power outputting section is transmitted to the helical spring 122 from the input part, and the power transmitted to the helical spring is transmitted to the output part, whereby the pressing plate is lowered by the power transmitted to the output part, until the power outputting section stops outputting the power for lowering the pressing plate. As a result, in case where the recording medium is still pressed against the feeding member by the pressing plate urging member even after the power for elevating the pressing plate has been stopped, the pressing plate is lowered by the power outputting section. Therefore, the time while the recording medium is pressed can be reduced to be as short as possible, and it is be possible to prevent duplicate feeding of the recording medium.

Also, the recording medium feeding device is further provided with the separating member 8 for separating a plurality of sheets of the recording medium which have been fed by the feeding member 7 into only one sheet. As a result, in case where two sheets of the recording medium but not one sheet have been fed at a time, it is possible to separate the recording medium into only one sheet by the separating member, and covey it. In addition to the advantage that probability of multiple feeding of the recording medium is decreased, the urging force of the separating member required for separating the recording medium is reduced, and it is possible to prevent occurrence of noises or paper dust when the recording medium is severely rubbed between the feeding member and the separating member.

Further, the recording medium having a plurality of sizes can be fed, and the pressing force with which the recording medium is pressed against the feeding member by the power transmitting section varies depending on the size of the recording medium and the number of the sheets stacked on the pressing plate, the pressing force becoming the smallest when the recording medium having the maximum feedable size is mounted on the pressing plate to the full. As a result, probability of multiple feeding of the recording medium is decreased. Therefore, the urging force of the separating member required for separating the recording medium is reduced, and it is possible to prevent occurrence of noises or paper dust when the recording medium is severely rubbed between the feeding member and the separating member can be prevented.

The image forming apparatus 1 is provided with the recording medium feeding device. As a results, it will be possible to smoothly feed the recording medium.

An image forming apparatus and a recording medium feeding device according to a second embodiment of the invention will be described referring to the drawings. Components corresponding to those components in the first embodiment will be denoted with the same reference numerals, and overlapping descriptions will be omitted.

Figure 6:
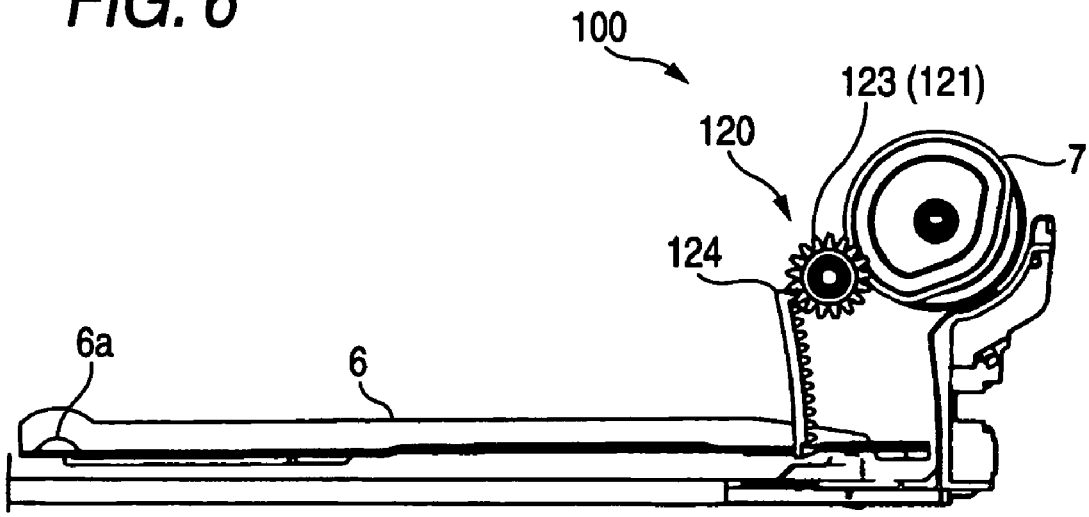
FIG. 6 is a side view showing an interior of a feeder unit according to a second embodiment of the invention, before image forming operation starts according to illustrative aspects of the invention.
Figure 7:
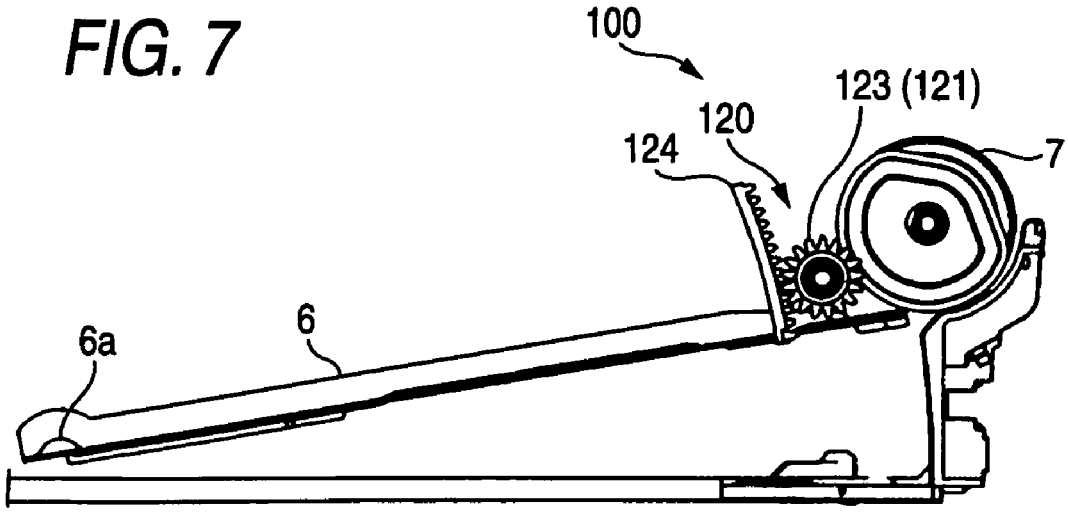
FIG. 7 is a side view showing the interior of the feeder unit of the second embodiment, after the image forming operation has started according to illustrative aspects of the invention.
Figure 9B:
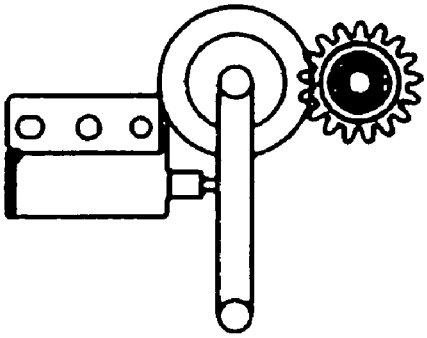
FIGS. 9A and 9B are a side view and a perspective view showing a mechanism for bringing a driving motor and a one-way clutch mechanism into engagement and for releasing the engagement according to illustrative aspects of the invention.
Figure 9A:
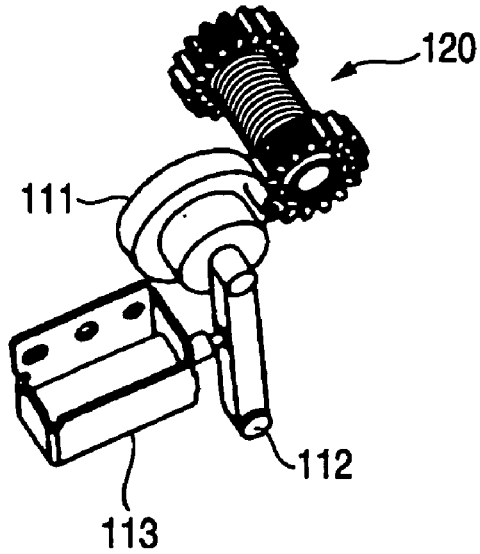

FIGS. 6 and 7 are a side view of an interior of a feeder unit 4 before the image forming operation starts, and a side view of the interior of the feeder unit 4 after the image forming operation has started, respectively. FIGS. 9A and 9B are a perspective view and a side view showing a mechanism for bringing a driving motor 110 and a one-way clutch mechanism 120 into engagement and for releasing the engagement.

In this embodiment, as shown in FIGS. 6 and 7, the urging spring 130 shown in the first embodiment is omitted, and the paper pressing plate 6 is elevated only by the one-way clutch mechanism 120. Consequently, the pressing force for pressing the sheets of paper 3 (not shown) against the paper feeding roller 7 is generated only by the one-way clutch mechanism 120, and is not influenced by the spring force of the urging spring 130, under any condition. Therefore, it is advantageous that the pressing force can be further reduced. On the other hand, when the paper pressing plate 6 is elevated only by the one-way clutch mechanism 120, period for elevating the paper pressing plate 6 will be longer than that in the first embodiment. However, in case where the paper pressing plate 6 is elevated, as shown in FIG. 7, with the same paper feeding operation as in the first embodiment, and the driving roller 110 is stopped immediately after the leading end portion of the sheet 3 fed by the paper feeding roller 7 has been clamped between the registration rollers 9, it is possible to elevate the paper pressing plate 6 for the next sheet 3 even while the sheet 3 is being fed by means of the paper feeding roller 7. As a result, it is possible to spare a longer time for the elevating motion, and to conduct the paper feeding operation without delay, totally. When the driving roller 110 is stopped immediately after the leading end portion of the sheet 3 fed by the paper feeding roller 7 has been clamped between the registration rollers 9, the driving gear 111 which is a part of a gear train connecting the driving motor 110 (not shown) with the one-way clutch mechanism 120 is separated from the one-way clutch mechanism 120 by means of a solenoid 113, as shown in FIGS. 9A and 9B. After the driving gear 111 has been separated from the one-way clutch mechanism 120, that is, the input gear 121 of the one-way clutch mechanism 120 has been released from connection with the driving motor 110, the rack 124 is lowered by gravities of the paper pressing plate 6, the sheets of paper 3 stacked on the paper pressing plate 6 and the rack 124 itself. Accordingly, the paper pressing plate 6 to which the rack 124 is fixed is also lowered. When the paper pressing plate 6 has been lowered to the waiting position where the sheet 3 will not be fed by the paper feeding roller 7, as shown in FIG. 6, the driving motor 110 is connected again with the one-way clutch mechanism 120 by means of the solenoid 113 and the driving gear 111, and the rack 124 is unable to rotate the output gear 123 of the one-way clutch mechanism 120, thereby to stop the lowering motion of the paper pressing plate 6.

Although the invention has been heretofore described referring to the embodiments, the present invention is not limited to the above described embodiments, but various improvements and modifications can be made within a scope not deviated from technical concept of the invention.

What is claimed is:

1. A recording medium feeding device comprising:

a feeding member that feeds a recording medium;

a plate on which the recording medium is placed;

an urging spring that urges the plate in an elevating direction;

a power outputting section that outputs a power; and a one-way clutch mechanism that is engaged with a rack fixed to the plate and transmits the power outputted from the power outputting section to the rack for elevating the plate, the one-way clutch mechanism being adapted so as not to transmit the power to the plate, when a repulsive force against the power for elevating the plate is larger than a predetermined value.

2. The recording medium feeding device according to claim 1, wherein the one-way clutch mechanism comprises:

an input part into which the power outputted from the power outputting section is inputted;

an output part for outputting the power that has been inputted into the input part in order to elevate the plate; and a helical spring that is wound around the input part and the output part and adapted to rotate in a direction of being slackened by the power outputted from the power outputting section, the helical spring being slackened in an area wound around the input part or the output part thereby to idly rotate, when the power outputted from the power outputting section has been inputted into the input part in an amount more than a predetermined value, whereby the power cannot be transmitted to the plate.

3. The recording medium feeding device according to claim 2, wherein after an output of the power for elevating the plate has been stopped, connection between the power outputting section and the input part is released, and the plate is lowered.

4. The recording medium feeding device according to claim 2, wherein after an output of the power for elevating the plate has been stopped, the power for lowering the plate is outputted from the power outputting section, the power outputted from the power outputting section is transmitted to the helical spring from the input part, and the power transmitted to the helical spring is transmitted to the output part, whereby the plate is lowered by the power transmitted to the output part, until the power outputting section stops outputting the power for lowering the plate.

5. The recording medium feeding device according to claim 1, wherein the urging spring is configured to feed the recording medium having a plurality of sizes, and the urging spring is constructed in such a manner that in a case where the recording medium having the maximum feedable size is placed on the plate to the full, the recording mediums is not brought into contact with the feeding member while the power for elevating the plate is not outputted.

6. The recording medium feeding device according to claim 1, further comprising a separating member that separates a plurality of recording mediums fed by the feeding member into only one sheet.

7. The recording medium feeding device according to claim 1, further comprising a conveying member that conveys the recording medium fed by the feeding member;

wherein the power outputting section stops outputting the power for elevating the plate, when a leading end portion of the recording medium is clamped by the conveying section.

8. The recording medium feeding device according to claim 1, wherein the recording medium feeding device is configured to feed the recording medium having a plurality of sizes; and a pressing force with which the recording medium is pressed against the feeding member by the one-way clutch mechanism varies depending on the size of the recording medium and the number of the sheets stacked on the plate, the pressing force becoming the smallest when the recording medium having the maximum feedable size is placed on the plate to the full.

9. An image forming apparatus comprising:

a recording medium feeding device that comprises: a feeding member that feeds a recording medium;

a plate on which the recording medium is placed;

a power outputting section that outputs a power for elevating the plate in a direction of pressing the recording medium against the feeding member; and a one-way clutch mechanism that transmits the power outputted from the power outputting section to the plate, the one-way clutch mechanism being adapted so as not to transmit the power to the plate, when a repulsive force against the power for elevating the plate is larger than a predetermined value.

10. A recording medium feeding device comprising:

a feeding member that feeds a recording medium;

a plate on which the recording medium is placed;

an urging spring that urges the plate in an elevating direction via a first force;

a power outputting section that outputs a power for elevating the plate via a second force; and a one-way clutch mechanism that transmits the power outputted from the power outputting section to the plate, the one-way clutch mechanism being configured to stop transmission of the power.

* * * * *